United States Patent [19]

Stanford

[11] 4,201,000

[45] May 6, 1980

[54] SNOW PLOW ATTACHMENT

[76] Inventor: George H. Stanford, 191 Spurwink Rd., Scarborough, Me. 04074

[21] Appl. No.: 910,373

[22] Filed: May 30, 1978

Related U.S. Application Data

[63] Continuation-in-part of Ser. No. 830,569, Sep. 6, 1977, abandoned.

[51] Int. Cl.[2] ..... E02F 3/76

[52] U.S. Cl. ..... 37/117.5; 37/DIG. 3; 414/912; 293/146; 293/DIG. 6

[58] Field of Search ..... 37/41, 42 R, 42 VL, 37/44, 50, 117.5; 172/801-809; 280/481; 293/DIG. 1, 38, 60, 64, 65, 69 R, 71 R, 73, 87, 90, 97-100, 146, DIG. 6, 102; 414/972

[56] References Cited

U.S. PATENT DOCUMENTS

| | | | |
|---|---|---|---|
| 1,805,933 | 5/1931 | Victor | 37/42 VL |
| 2,487,496 | 11/1949 | Tyson | 293/69 R X |
| 2,999,697 | 9/1961 | Winget | 172/801 X |
| 3,302,958 | 2/1967 | Fawcett et al. | 37/42 R X |
| 3,310,330 | 3/1967 | Kessler | 293/69 R X |
| 3,378,084 | 4/1968 | Ulrich | 280/481 X |
| 3,378,296 | 4/1968 | Crocker | 293/65 X |
| 3,431,005 | 2/1969 | Priefert | 293/65 |
| 3,563,595 | 2/1971 | Slavney | 293/71 R X |
| 3,608,942 | 9/1971 | Telles | 293/65 |
| 3,987,562 | 10/1976 | Deen et al. | 37/42 R |

*Primary Examiner*—E. H. Eickholt

[57] ABSTRACT

A snow plow attachment includes a first part for engagement with a bumper of a stalled vehicle and detachably attachable to the blade of the snow plow and a rearwardly disposed second part engageable with the central portion of the blade, vertically considered, to brace the first part in its bumper-engaging position. In one embodiment of the invention, the attachment is secured to the upper portion of the plow blade and in another, the attachment is secured to both upper and lower portions thereof.

11 Claims, 8 Drawing Figures

Fig. 1
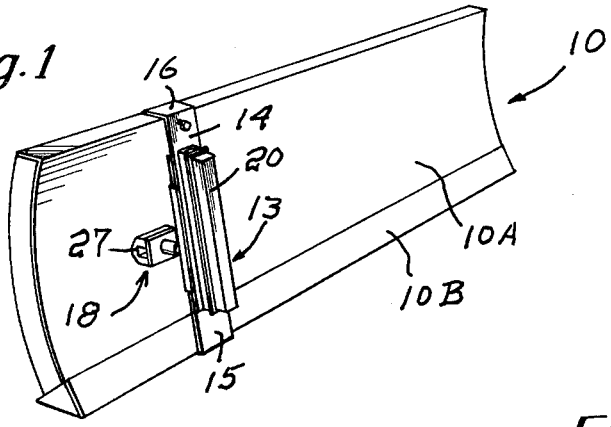
Fig. 2
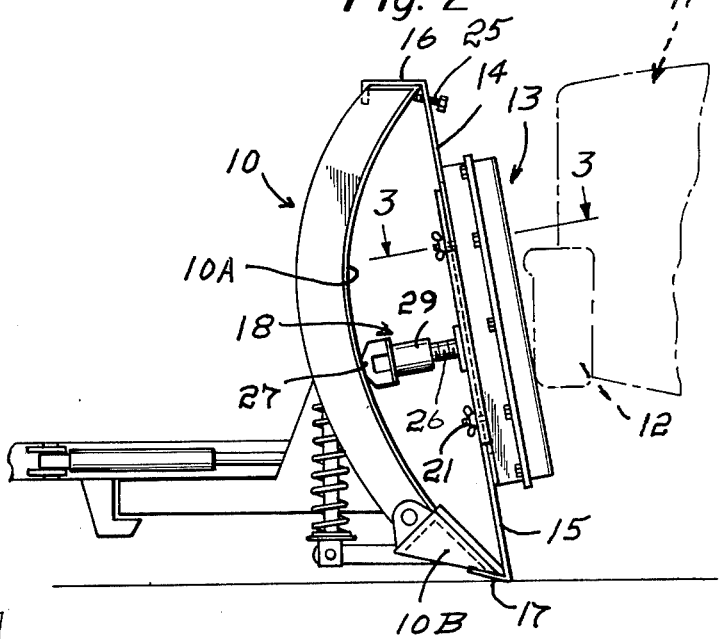
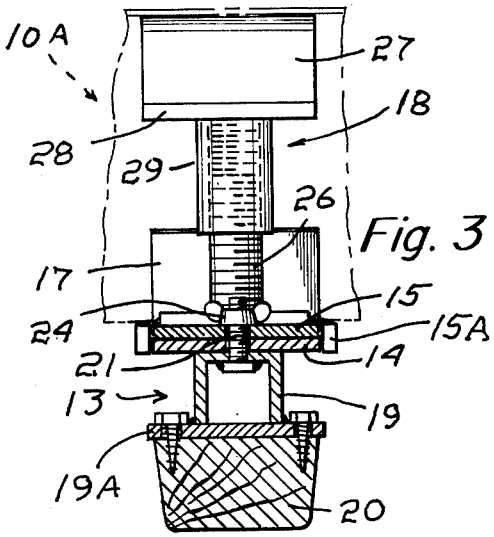
Fig. 3
Fig. 4
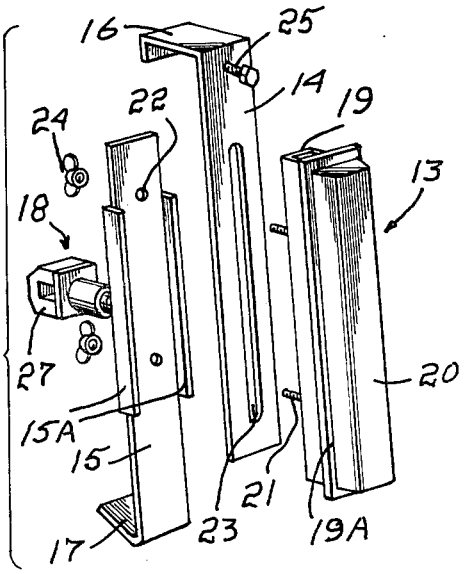

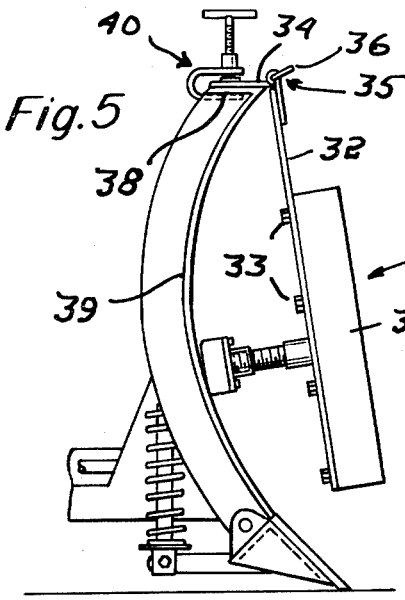
Fig. 5
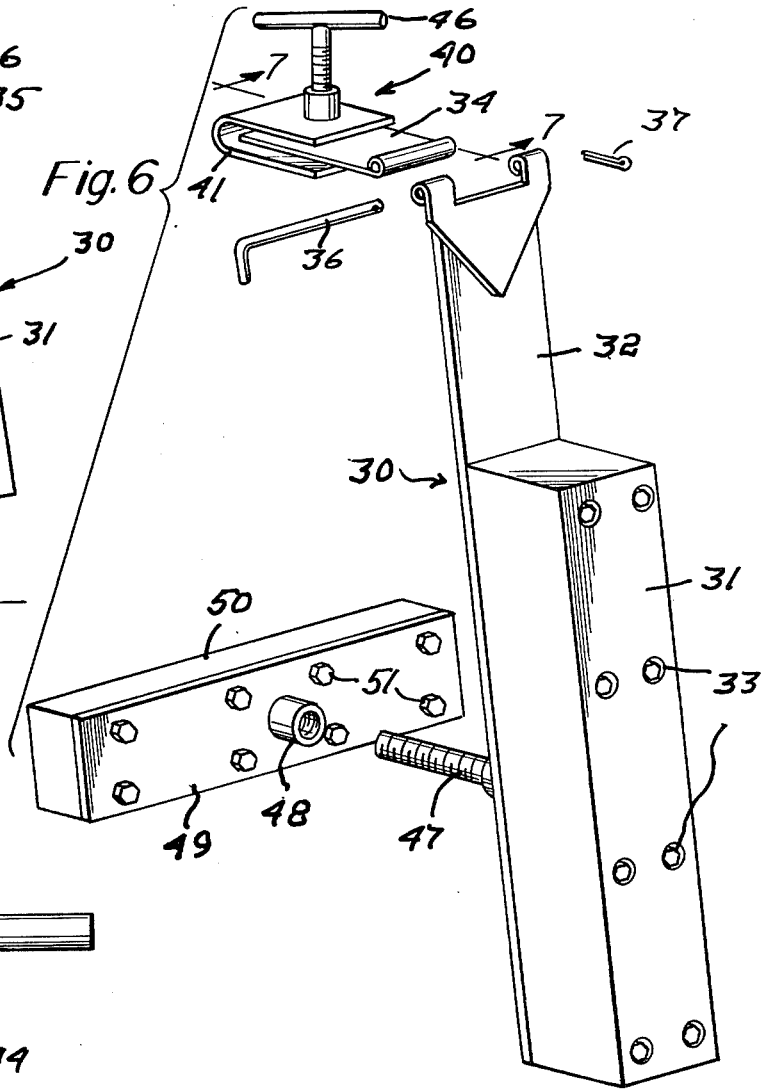
Fig. 6
Fig. 7
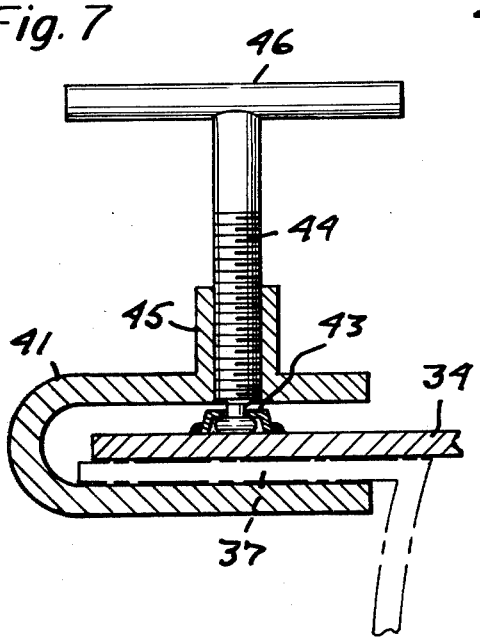
Fig. 8
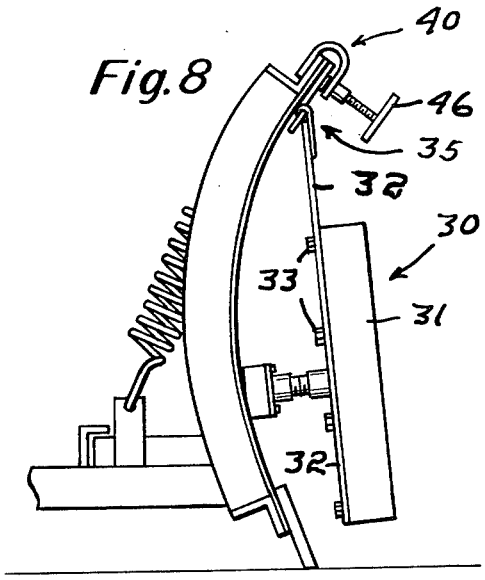

SNOW PLOW ATTACHMENT

The present application is a continuation-in-part of application Ser. No. 830,569, filed Sept. 6, 1977, and now abandoned.

BACKGROUND REFERENCES

U.S. Pat. No. 1,805,933
U.S. Pat. No. 2,487,496
U.S. Pat. No. 2,841,894
U.S. Pat. No. 2,999,697
U.S. Pat. No. 3,302,958
U.S. Pat. No. 3,310,330
U.S. Pat. No. 3,378,084
U.S. Pat. No. 3,431,005
U.S. Pat. No. 3,563,595
U.S. Pat. No. 3,608,942
U.S. Pat. No. 3,987,562
Australian Letters Pat. No. 278,004

BACKGROUND OF THE INVENTION

One of the problems in clearing streets and parking areas with snow plows is that presented by any parked vehicle or vehicles that have become stuck. The usual procedure is to plow around such a vehicle which, of course, makes its subsequent removal more difficult and leaves the street or parking area in a condition requiring further use of a plow.

It is, of course, obvious that the plowing vehicle would be capable of pushing another vehicle into the clear were it not for its plow and that the time, inconvenience and difficulty of unhitching and rehitching the plow makes it impractical for plowing vehicles to be used in moving stalled or parked vehicles with the result that such vehicles are freed from the snow at a later time and usually by another vehicle.

In the above referred to U.S. Pat. No. 2,841,894, blades such as bulldozer and snow plow blades were shown as including upper and lower arcuate portions, the lower portion hingedly connected to the lower edge of the upper portion so that it may be swung from a blade-establishing position upwardly and forwardly against the first portion to establish a bumper. As far as I am aware, such a combination blade and bumper has not been commercially utilized and the bumper was not adapted for use in pushing vehicles.

THE PRESENT INVENTION

The general objective of the present invention is to provide an attachment for a snow plow blade that enables the plowing vehicle to the quickly and easily converted into one by which a vehicle can be safely pushed without the risk of damaging it.

In accordance with the invention, this objective is attained with an attachment including a first part that is to engage the bumper of the vehicle to be pushed, means detachably connecting the first part to the plow blade in a position such that only the vehicle bumper is engaged while the vehicle is being pushed, and a second part engageable with a central portion of the blade, vertically considered, and operable to brace the first part against any material rearward movement from its bumper-engaging position, the attachment sufficiently light in weight and so constructed as to permit it to be quickly and easily attached by one person to the plow blade and as quickly and easily removed therefrom even under adverse weather conditions while of adequate strength to enable vehicles to be safely pushed when in position.

In order that the attachments may combine adequate strength with lightness in weight, the first part is narrow in relation to its vertical extent which is, in practice, in the neighborhood of one-half of the height of the plow blade, and the second part is dimensioned to engage the plow blade in a lengthwise zone such that, during use, the second part will not be laterally displaced to any material extent thus enabling the weight of the attachment attributable to the attaching means to be minimized.

Another objective of the invention is to provide that the means detachably attaching the first parts of the attachments to the plow blades are of a type enabling them to be connected to have an operative position where wanted, lengthwise of the plow blades to ensure proper engagement with the bumper of the vehicle that is to be pushed.

Another objective of the invention is to provide attachment connecting means that make unnecessary the welding of any part of said means to the plow blade, an objective attained in one embodiment of the invention with a clamp that can be secured to a flange extending lengthwise of the upper edge of the plow blade and preferably including a hinge located to permit the first part to hang vertically with the second part then adjustable, if necessary, as required by the size and construction of the plow blade, to brace the first part in its wanted operative position.

Another objective of the invention is to provide that the first part is capable of properly engaging vehicle bumpers under all conditions, an objective attained with the first part of substantial vertical extent and with the second part centrally thereof and desirably the first part includes a vertical post and a member attached thereto of a material that will not damage the engaged bumper and having sliding contact therewith.

Yet another objective of the invention is to provide a second part that does not require a positive connection with the blade, an objective attained with a second part that in one embodiment includes a member that frictionally engages a central portion of the blade, vertically considered, in a manner preventing any material vertical movement of the second part and in another embodiment is a member dimensioned to engage the blade lengthwise of a relatively narrow area in a central portion of the blade, vertically considered.

In another objective of the invention, the above objective is attained by providing that the attaching means include first and second members, each including a hook to be caught, in the case of the first member, over the upper edge of the blade and in the case of the second member, under the bottom edge thereof, either and preferably both of the members vertically adjustable relative to each other.

Yet another objective of the invention is to enable the second part to back the first part and hold it in its bumper-engaging position with snow plow blades of different sizes or constructions, an objective attained by providing the second part with adjustable means by which the blade-engaging member thereof may be moved towards or away from the first part as required to maintain the first part in its wanted position.

BRIEF DESCRIPTION OF THE DRAWINGS

The accompanying drawings illustrate preferred embodiments of the invention and

FIG. 1 is a front perspective view of a snow plow blade with an attachment in accordance with the invention secured thereto;

FIG. 2 is a side view thereof, on an increase in scale;

FIG. 3 is a section, on a further increase in scale, taken approximately along the indicated line 3—3 of FIG. 2;

FIG. 4 is an exploded view of the attachment;

FIG. 5 is a view similar to FIG. 5 illustrating an attachment in accordance with another embodiment of the invention;

FIG. 6 is an exploded view, on an increase in scale, of the attachment shown in FIG. 5;

FIG. 7 is a section, on a further increase in scale, taken approximately along the indicated line 7—7 of FIG. 6; and FIG. 8 is a view, similar to FIG. 5, illustrating the connection of the attachment of FIG. 6 to a different plow blade.

THE PREFERRED EMBODIMENTS OF THE INVENTION

In the embodiment of the invention illustrated by FIGS. 1–4, the snow plow blade, generally indicated at 10, is conventional and will not be detailed other than to note that it includes a curved, fixed moldboard 10A and a trip edge or tripbase angle 10B. In FIG. 2, the rear 11 of an automobile including the rear bumper 12 is shown in phantom. It will be apparent that the automobile would be damaged were an attempt made to push it with a plow-equipped truck.

The attachment enables the plow to be quickly adapted for use in the safe pushing of a vehicle either stalled or snow trapped and still permit snow to be plowed.

The attachment includes a first part, generally indicated at 13, that is to engage the bumper 12, members 14 and 15 including hooks 16 and 17, respectively, with the hook 16 caught over the upper edge of the modlboard 10A and the hook 17 caught under the trip base angle 10B with the first part 13 in a position such that only the vehicle bumper 12 is engaged during the pushing of the vehicle 11, and a second part, generally indicated at 18 engageable with a central portion, vertically considered, of the moldboard 10A to brace the first part 13 against any material rearward movement from its bumper-engaging position.

The first part 13 includes a hollow, vertical metal, flanged post 19 and a bumper-engaging member 20 detachably secured thereto, both of substantial extent in order to ensure engagement with the bumper 12 under a wide range of conditions. The post 19 has vertically spaced threaded studs 21 welded to the rear face thereof. The member 20 which is secured to the post flanges 19A, is of a material that will not damage the bumper 12 and while shown as wood it may be of a material providing for a cushioned and desirably, a slidable engagement with the bumper 12.

The members 14 and 15 are steel strips with portions overlapping with the member 15 having stud-receiving holes 22 and the member 14 which is between the member 15 and the post 19 has a lengthwise slot 23 through which the studs 21 extend. The member 15 is shown as having flanges 15A between which the member 14 fits. Nuts 24 threaded on the studs 21, when loosened, permit movement of the members 14 and 15 such that their hooks can be caught over the upper and lower edges of the plow blade 10 and when tightened, secure the attachment. It will be seen that while the hook 17 is V-shaped, the hook 16 is U-shaped as the upper edge of the moldboard 10A is relatively thick with the thickness varying from one make of blade to another. In order that the hook 16 will not be a loose fit, the member 14 has an upwardly and rearwardly angled set screw 25 engageable with the moldboard 10A adjacent its upper edge.

In the disclosed embodiment of the invention, the second part 18 has a threaded post 26 welded to the rear face of the member 15. A member 27 engageable with the moldboard 10A is carried by a mount 28 provided with an internally threaded sleeve 29 and receiving the post 26 to establish an adjustable connection that ensures that the first part 13 is so braced that it is held in its wanted position. The member 27 is of rubber or faced with rubber or other material ensuring such frictional engagement with the moldboard 10A as to prevent unwanted vertical movement of the part 18 while a vehicle is being pushed. Desirably and as shown the member 27 is somewhat elongated.

In the embodiment of the invention illustrated by FIGS. 5–8, the first bumper-engaging part is generally indicated at 30, which may be an elongated wooden block, and is secured to the lower end of a flat bar 31 by bolts 32. The upper end of the bar 31 is connected to an attaching plate 33 by a hinge 34, the pintle 35 of which is releasably held by a cotter pin 36.

While the attaching plate 33 may be welded to the upper edge flange 37 of the snow plow blade 38, it is shown as detachably secured thereto by a clamp generally indicated at 39. For this purpose, the clamp 39 is desirably of the type detailed in FIG. 7, and has a base 40 in the form of a channel dimensioned to receive the flange 37 and the attaching plate 33 with the lower channel wall, a fixed jaw and the attaching plate attached by the coupling 41 to the inner end of a stem 42 to permit the stem to be turned independently of the attaching plate 33. The stem 42 is threaded through a boss 43 formed on the upper channel wall and provided with a handle 44 enabling the attaching plate 33 to be quickly and easily locked to or removed from any lengthwise position along the flange 37.

In practice, the anchored clamp 39 with the attaching plate 33 securely held thereby is left on the blade flange 37 in that position lengthwise thereof in which the attachment is usually used and the attachment itself is stored in the truck. The attachment is light in weight and easily attached or removed by withdrawing and again inserting the pintle 35 and locking it by means of the cotter pin 36.

The bar 31 is of sufficient length so that when attached to the snow plow blade, it extends below the center of the blade 38, vertically considered. Secured to the bar 31, desirably centrally with respect to the bumper-engaging part 30 is the second part of the attachment consisting of a rearwardly disposed post 45 on which is threaded a socket 46 located centrally of a flat bar 47 to which a block 48, which may be a wood block, is secured as by bolts 49. The bar and block are, when the attachment is in place, disposed lengthwise of the mold board of the blade 38 and the length of the cooperating threads of the socket 46 and of the post 45 enabling the position of the member 30 relative to the blade 38 to be adjusted as required to establish its operative position.

The described embodiments of the invention are sufficiently light weight to enable one person to install one quickly and easily in any selected position lengthwise of the plow blade required for the safe pushing of a vehicle. At the same time, the construction of the attachment enables vehicles to be pushed safely in spite of their light weight and their small size and permits one to be easily stored in the truck until its use is again required.

It will thus be apparent, that attachments in accordance with the invention are easily secured to and removed from a snow plow blade even under adverse weather conditions and that while attached, the plow can still be used for plowing purposes under most conditions.

I claim:

1. An attachment for a concave snow plow blade to enable a vehicle equipped with such a plow to push a bumper-equipped vehicle, said attachment including a first part that is to engage the vehicle bumper and of substantial vertical extent, hinge means detachably attaching said part at least to the upper portion of the blade in a position such that only the vehicle bumper is engaged during the pushing thereof, a second part and means connecting said second part to said first part to extend rearwardly thereof, said second part including a member engageable with a zone of substantial length in the central portion of the blade, vertically considered, when the first part is attached to the plow blade and then operable to brace the first part against any material rearward movement from said position while a vehicle is being pushed, the width of said first part less than the vertical extent thereof and the length of said member greater than the width thereof so as to then prevent any material lateral displacement of said second part.

2. The attachment of claim 1 in which the upper edge of the plow blade includes a rearwardly disposed flange and the hinge means includes a clamp engageable with said plow blade flange and a hinge spaced forwardly therefrom a distance such that said first part hangs vertically.

3. The attachment of claim 1 in which the upper edge of the plow blade includes a rearwardly disposed part terminating in a vertically disposed flange, and the hinge means includes a clamp engageable with the said plow blade flange and a hinge spaced forwardly therefrom a distance such that said first part hangs vertically.

4. The attachment of claim 1 in which the connecting means are adjustable to vary the distance between said parts.

5. An attachment for a concave snow plow blade to enable a vehicle equipped with such a plow to push a bumper-equipped vehicle, said attachment including a first part that is to engage the vehicle bumper and of substantial vertical extent, means detachably attaching said part to the blade in a position such that only the vehicle bumper is engaged during the pushing thereof, said attaching means including a first member provided with a hook to be caught over the upper edges of the blade and a second member provided with a hook to be caught under the bottom edge thereof, a second part and means connecting said second part to said first part to extend rearwardly thereof, said second part including a member engageable with a zone of predetermined length in the central portion of the blade, vertically considered, when the first part is attached to the plow blade and then operable to brace the first part against any material rearward movement from said position while a vehicle is being pushed, the width of said first part less than the vertical extent thereof and said attaching means including first and second members that are vertically adjustable.

6. The attachment of claim 5 in which the second part includes a rubber blade-engaging member that frictionally resists vertical movement of and cushions the second part while a vehicle is being pushed, and the second part includes an adjustable connection with its blade-engaging member enabling the position of said member relative to the first part to be adjusted as required by the blade in order to seat thereagainst with the first part in said bumper-engaging position.

7. The attachment of claim 5 in which the hook of the first member is U-shaped and dimensioned to straddle an upper blade edge of a predetermined maximum section and said first member includes a set screw adjacent the hook thereof and angled rearwardly and upwardly to engage the blade below said edge and operable to draw said hook against a narrower upper edge.

8. The attachment of claim 6 in which the adjustable connection includes a fixed threaded element and the blade-engaging member includes a part threaded thereon.

9. The attachment of claim 5 and means interconnect the first and second members for sliding engagement thus to vary the distance between the hooks thereof and include nuts operable to lock the means to hold the members against relative movement.

10. The attachment of claim 5 in which the second member includes vertically spaced, nut-receiving studs, the first member is between the second member and the first part and has a lengthwise slot through which the studs extend and the second member has holes spaced to receive the studs and the backing part is secured to the second member.

11. The attachment of claim 5 in which the second member has marginal flanges between which the first member fits.

* * * * *